US011857071B2

(12) United States Patent
Zi et al.

(10) Patent No.: US 11,857,071 B2
(45) Date of Patent: Jan. 2, 2024

(54) DRAWER SYNCHRONOUS SLIDE

(71) Applicant: GUANGDONG UNIHOPPER PRECISION TECHNOLOGY CORPORATION LIMITED, Guangdong (CN)

(72) Inventors: Bin Zi, Guangdong (CN); Zhuofang Zhu, Guangdong (CN)

(73) Assignee: GUANGDONG UNIHOPPER PRECISION TECHNOLOGY CORPORATION LIMITED, Zhaoqing (CN)

( * ) Notice: Subject to any disclaimer, the term of this patent is extended or adjusted under 35 U.S.C. 154(b) by 0 days.

(21) Appl. No.: 17/776,589

(22) PCT Filed: Jan. 20, 2020

(86) PCT No.: PCT/CN2020/073085
§ 371 (c)(1),
(2) Date: May 12, 2022

(87) PCT Pub. No.: WO2021/120367
PCT Pub. Date: Jun. 24, 2021

(65) Prior Publication Data

US 2022/0378203 A1 Dec. 1, 2022

(30) Foreign Application Priority Data

Dec. 18, 2019 (CN) ..... 201911309762.9

(51) Int. Cl.
*A47B 88/49* (2017.01)
*A47B 88/497* (2017.01)

(52) U.S. Cl.
CPC ..... *A47B 88/497* (2017.01); *A47B 88/49* (2017.01); *A47B 2210/0064* (2013.01)

(58) Field of Classification Search
CPC . A47B 88/49; A47B 88/497; A47B 2210/007; A47B 2210/0013; A47B 2210/0064
(Continued)

(56) References Cited

U.S. PATENT DOCUMENTS 9,784,314 B2 * 10/2017 Ng ..... F16C 33/48
9,993,077 B2 * 6/2018 Chen ..... A47B 88/447
10,506,879 B1 * 12/2019 Chen ..... A47B 88/447

FOREIGN PATENT DOCUMENTS

CN 102665489 A 9/2012
CN 110464142 A 11/2019

OTHER PUBLICATIONS

International Search Report of PCT Patent Application No. PCT/CN2020/073085 dated Sep. 2, 2020.

* cited by examiner

*Primary Examiner* — James O Hansen

(57) ABSTRACT

A drawer synchronous slide includes a fixed slide rail (1), a middle slide rail (2), and a movable slide rail (3) connected to each other slidably, wherein a synchronizing gear (8) is arranged on the middle slide rail (2), a first synchronizing rack (6) and a second synchronizing rack (7) arranged horizontally and oppositely are respectively fixed onto the movable slide rail (3) and the fixed slide rail (1), left and right sides of the synchronizing gear (8) are respectively meshed and work in conjunction with a tooth-shaped part of the first synchronizing rack (6) and a tooth-shaped part of the second synchronizing rack (7), an elastic part (61) is arranged on the first synchronizing rack (6), the tooth-shaped part of the first synchronizing rack (6) is elastically pressed towards the synchronizing gear (8) under the action of elastic stress of the elastic part (61).

7 Claims, 9 Drawing Sheets

(58) Field of Classification Search
USPC ..... 312/331
See application file for complete search history.

DRAWER SYNCHRONOUS SLIDE

TECHNICAL FIELD

The present disclosure relates to the technical field of drawer slide structures, and in particular to a drawer synchronous slide.

BACKGROUND

The common drawer slide is divided into upper, middle, and lower sections. There are rollers or balls between the upper rail and the middle rail, and between the middle rail and the lower rail. The rollers and balls are constrained by a cage. Due to the rolling friction between the slide rails when a drawer moves, it is more labor-saving. In the use of three-section slide rails, it is found that due to differences in the accuracy of parts and assembly methods, the rolling friction between the slide rails is uneven, and the sequence of opening and closing between the slide rails is uncertain, resulting in inconsistent drag resistance on left and right sides of the drawer and affecting the hand feel, which needs to be improved.

CN 201910732110.X filed by this applicant disclosed a drawer slide that a synchronizing element is meshed and works in conjunction with a first synchronizing slide bar and a second synchronizing slide bar to ensure the synchronization and stability of a fixed slide rail, a middle slide rail, and a movable slide rail in a drawing process. Using such a gear and rack matching structure to maintain a proportional relationship of movement requires a relatively fixed center distance between the gear and the rack. When the center distance becomes smaller, there is no gap or even interference between the teeth during meshing, the friction force is large, the wear is serious, and there is noise and runout at a fixed frequency during the movement of the slide. When the center distance becomes larger, the gear and the rack are separated, which weakens the meshing strength, or makes the movement not smooth and causes a sense of frustration, or even the gear and the rack are completely separated, resulting in transmission failure.

During the use of the slide, there is a swing amount, such that the movable slide rail (upper rail) swings clockwise or counterclockwise relative to the fixed slide rail or the middle slide rail, resulting in the increase or decrease of the center distance and the instability of the drawing action of the slide.

SUMMARY

In view of the deficiencies of the prior art, an objective of the present disclosure is to provide a drawer synchronous slide with good stability.

In order to achieve the above objective, the solution provided by the present disclosure is a drawer synchronous slide, including a fixed slide rail, a middle slide rail, and a movable slide rail connected to each other slidably. A synchronizing gear is arranged on the middle slide rail, a first synchronizing rack and a second synchronizing rack arranged horizontally and oppositely are respectively fixed onto the movable slide rail and the fixed slide rail, left and right sides of the synchronizing gear are respectively meshed and work in conjunction with a tooth-shaped part of the first synchronizing rack and a tooth-shaped part of the second synchronizing rack, an elastic part is arranged on the first synchronizing rack, the tooth-shaped part of the first synchronizing rack is elastically pressed towards the synchronizing gear under the action of elastic stress of the elastic part, and at least one limiting gear in abutment fit with each of the first synchronizing rack and the second synchronizing rack is arranged on the synchronizing gear.

Further, the synchronizing gear and the limiting gear may be arranged coaxially.

Further, the drawer synchronous slide may include two limiting gears, and an axis of any one of the limiting gears may be parallel to an axis of the synchronizing gear.

Further, a first pressure-bearing part and a second pressure-bearing part that are in abutment fit with a peripheral surface of the limiting gear may be respectively formed on the first synchronizing rack and the second synchronizing rack.

Further, the limiting gear may be integrally formed below the synchronizing gear, and the limiting gear may have a diameter close to a pitch circle diameter of the synchronizing gear.

Further, the drawer synchronous slide may further include a gear seat for rotating and installing the synchronizing gear. The gear seat may be installed at a bottom end of an outer side wall of the middle slide rail.

Further, a vertically extending elliptical shaft may be formed on the gear seat, a circular hole matched with the elliptical shaft may be formed at a central position of the synchronizing gear, and an adjustment gap may be provided between an outer wall of the elliptical shaft in a short shaft direction and an inner wall of the circular hole, such that the synchronizing gear is finely adjusted with the gear seat in the short shaft direction of the elliptical shaft.

Further, one end of the gear seat may be hinged on the middle slide rail, such that the gear seat is capable of swinging around a hinged shaft.

Further, a first clamping part may be formed on the first synchronizing rack, a second clamping part may be formed on the second synchronizing rack, and the first clamping part may be slidably clamped with the second clamping part, such that the first synchronizing rack and the second synchronizing rack are capable of sliding relative to each other only in a drawing direction.

Further, a first cage may be arranged between the fixed slide rail and the middle slide rail, and a second cage may be arranged between the middle slide rail and the movable slide rail.

The present disclosure has the following beneficial effects: the elastic part on the first synchronizing rack generates an inward elastic stress on its tooth-shaped part, such that the tooth-shaped part always elastically presses the synchronizing gear inwards, and the tooth-shaped part and the synchronizing gear are elastically adapted to the change of a center distance to enhance the stability of the slide.

and

Figure 9:
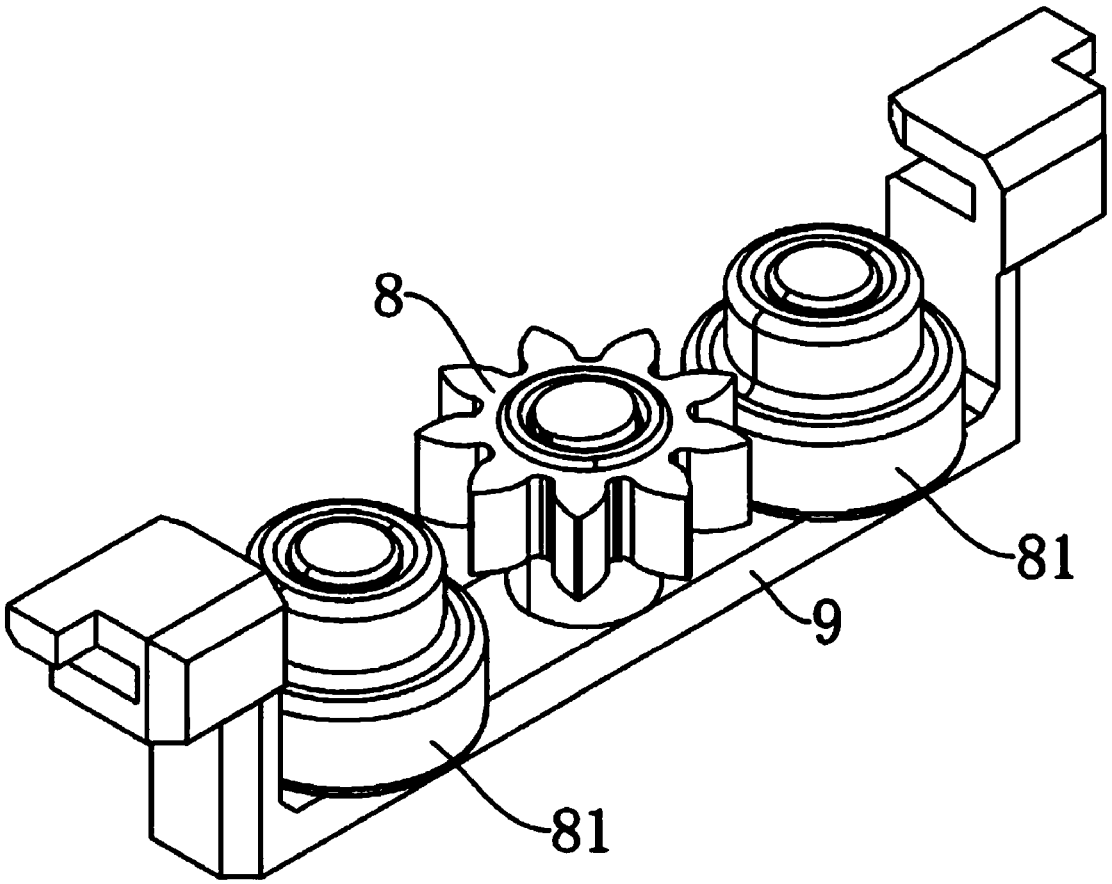

FIG. 9 is a schematic diagram of a synchronizing gear and a gear seat of Embodiment III.

In the figures, 1—a fixed slide rail, 2—a middle slide rail, 3—a movable slide rail, 4—a second cage, 5—a first cage, 6—a first synchronizing rack, 61—an elastic part, 7—a second synchronizing rack, 8—a synchronizing gear, and 9—a gear seat.

DETAILED DESCRIPTION

In order to facilitate the understanding of the present disclosure, the present disclosure is described more completely below with reference to the accompanying drawings. The drawings show preferred implementations of the present disclosure. The present closure is embodied in various forms without being limited to the implementations set forth herein. Rather, these implementations are provided so that the disclosure contents of the present disclosure will be understood more thoroughly and comprehensively. It should be noted that the above-mentioned "first" and "second" do not represent the specific quantity and order, and they are merely used to distinguish the name.

Embodiment I:

With reference to FIG. 1 to FIG. 6, in the present embodiment, a drawer synchronous slide includes a fixed slide rail 1, a middle slide rail 2, and a movable slide rail 3 connected to each other slidably. A first cage 5 is arranged between the fixed slide rail 1 and the middle slide rail 2, and a second cage 4 is arranged between the middle slide rail 2 and the movable slide rail 3. The first cage 5 and the second cage 4 in the present embodiment are both composed of a ball installing frame and several balls installed on the ball installing frame, and neither the first cage 5 nor the second cage 4 of the present disclosure has a rack. The first cage 15 and the second cage 4 are used as slidable supports for the fixed slide rail 1 and the middle slide rail 2, and the middle slide rail 2 and the movable slide rail 3. In the present embodiment, a drawing direction of the slide is defined as a front-rear direction, and a direction perpendicular to the drawing direction is a left-right direction.

In the present embodiment, the drawer synchronous slide further includes a synchronizing gear 8, a first synchronizing rack 6, a second synchronizing rack 7, and a gear seat 9. The first synchronizing rack 6 and the second synchronizing rack 7 are respectively independently and fixedly arranged on the movable slide rail 3 and the fixed slide rail 1, that is, the second synchronizing rack 7 of the present embodiment is fixedly arranged on a second outer side wall 11 of the fixed slide rail 1, and a tooth-shaped part of the second synchronizing rack 7 is horizontally outward and extends in the drawing direction. Specifically, an upper end position of the second synchronizing rack 7 is fixed on the second outer side wall 11, and the tooth-shaped part of the second synchronizing rack 7 is located at its lower end position. The first synchronizing rack 6 in the present embodiment can be fixedly arranged on a first outer side wall 31 of the movable slide rail 3, and a tooth-shaped part of the first synchronizing rack 6 is horizontally inward and extends in the drawing direction. Specifically, an upper end position of the first synchronizing rack 6 is fixed on the first outer side wall 31, and the tooth-shaped part of the first synchronizing rack 6 is located at its lower end position. The tooth-shaped part of the first synchronizing rack 6 and the tooth-shaped part of the second synchronizing rack 7 are arranged horizontally and oppositely.

In the present embodiment, an elastic part 61 is further integrally formed on the first synchronizing rack 6. The elastic part 61 is located at a middle position of the first synchronizing rack 6 and extends in the drawing direction. The elastic part 61 is pre-deformed, such that its lower end generates an inward elastic stress on the tooth-shaped part located at the lower end position of the first synchronizing rack 6.

In the present embodiment, the gear seat 9 is of a U-shaped structure, a vertically extending elliptical shaft 91 is formed on the gear seat 9, and a circular hole 83 embedded and matched with the elliptical shaft 91 is formed at a central position of the synchronizing gear 8, such that the synchronizing gear 8 is rotatably installed on the gear seat 9. An elastic claw is formed at a top end of the elliptical shaft 91 for fixed assembly of the gear seat 9. In addition, an adjustment gap is provided between an outer wall of the elliptical shaft 91 in a short shaft direction and an inner wall of the circular hole 83 (an outer wall of the elliptical shaft 91 in a long shaft direction is in contact with the inner wall of the circular hole 83), such that relative displacement adjustment can be made between the circular hole 83 and the elliptical shaft 91 in the short shaft direction, and the synchronizing gear 8 is finely adjusted with the gear seat 9 in the left-right direction.

Further, an upper part of the gear seat 9 is fixedly installed at a bottom end position of an outer side wall of the middle slide rail 2, such that the synchronizing gear 8 and the gear seat 9 are fixedly installed on the middle slide rail 2. Left and right sides of the synchronizing gear installed on the middle slide rail 2 are respectively meshed and work in conjunction with the tooth-shaped part of the first synchronizing rack 6 and the tooth-shaped part of the second synchronizing rack 7, effectively ensuring the synchronization and stability of the fixed slide rail 1, the middle slide rail 2, and the movable slide rail 3 in the drawing process.

In the drawing process, the tooth-shaped part of the first synchronizing rack 6 is elastically pressed towards the synchronizing gear 8 by the elastic stress of the elastic part 61 on the tooth-shaped part of the first synchronizing rack 6, thereby making the synchronizing gear 8 be in elastic contact with the tooth-shaped part of the first synchronizing rack 6, which can be effectively adapted to the change of a center distance caused by the swing of the movable slide rail 3, and ensure that the synchronizing gear 8 always cooperates with the tooth-shaped part. In addition, the synchronizing gear can be finely adjusted by combining the adjustment gap, which is more convenient for installation and more convenient for the meshing and matching of the two gear parts.

In the present embodiment, limiting gears arranged coaxially are formed on the synchronizing gear, the limiting gear is integrally formed below the synchronizing gear, and a first pressure-bearing part 60 and a second pressure-bearing part 70 that are in abutment fit with a peripheral surface of the limiting gear are respectively formed on the first synchronizing rack 6 and the second synchronizing rack 7. The first pressure-bearing part 60 and the second pressure- bearing part 70 work in conjunction with the limiting gear in an abutting manner, such that a diameter width of the limiting gear is used as the minimum center distance to prevent the center distance between the synchronizing gear 8 and the tooth-shaped part of the second synchronizing rack 7 from being too small.

Further, the limiting gear 81 of the present embodiment is integrally formed below the synchronizing gear 8, and the limiting gear 81 has a diameter equal to a pitch circle diameter of the synchronizing gear 8.

Based on the above component structures, the drawer synchronous slide is formed, and the drawing action is smoother and more stable.

Embodiment II

Figure 1:
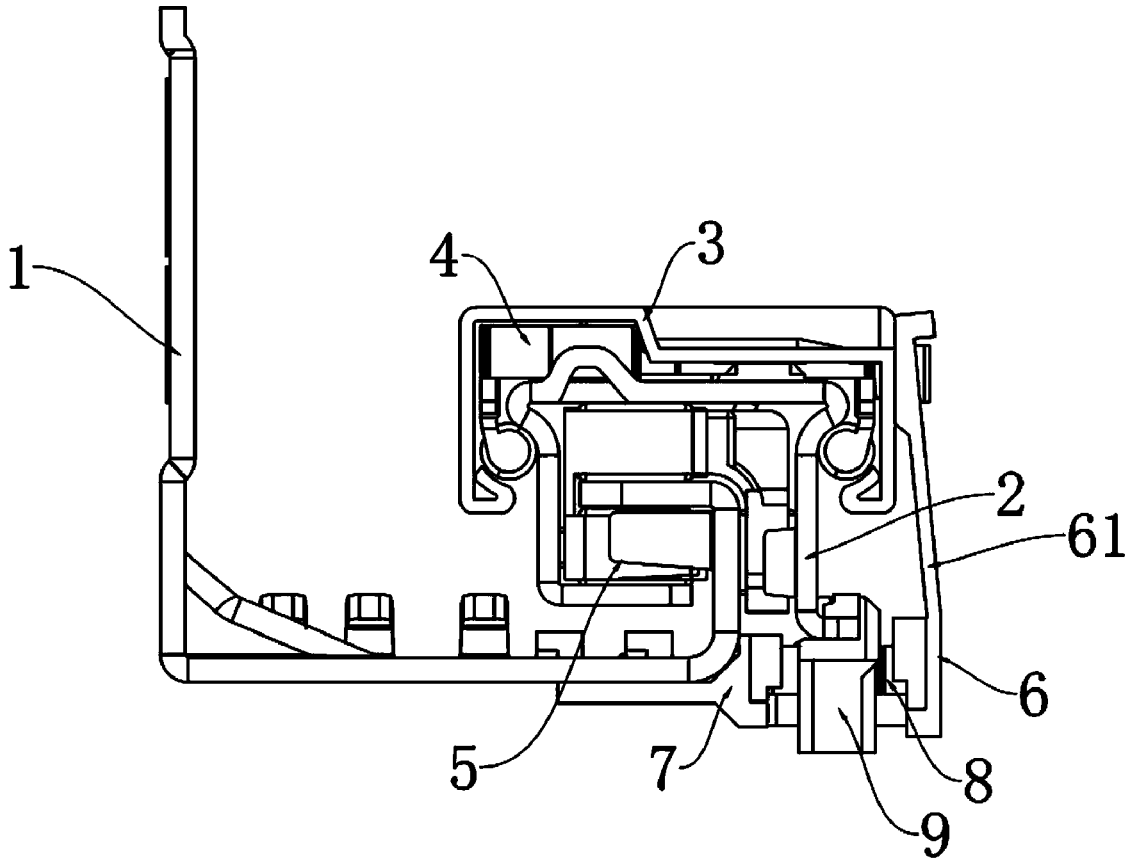
FIG. 1 is a schematic structural diagram of a drawer slide of Embodiment I.
Figure 2:
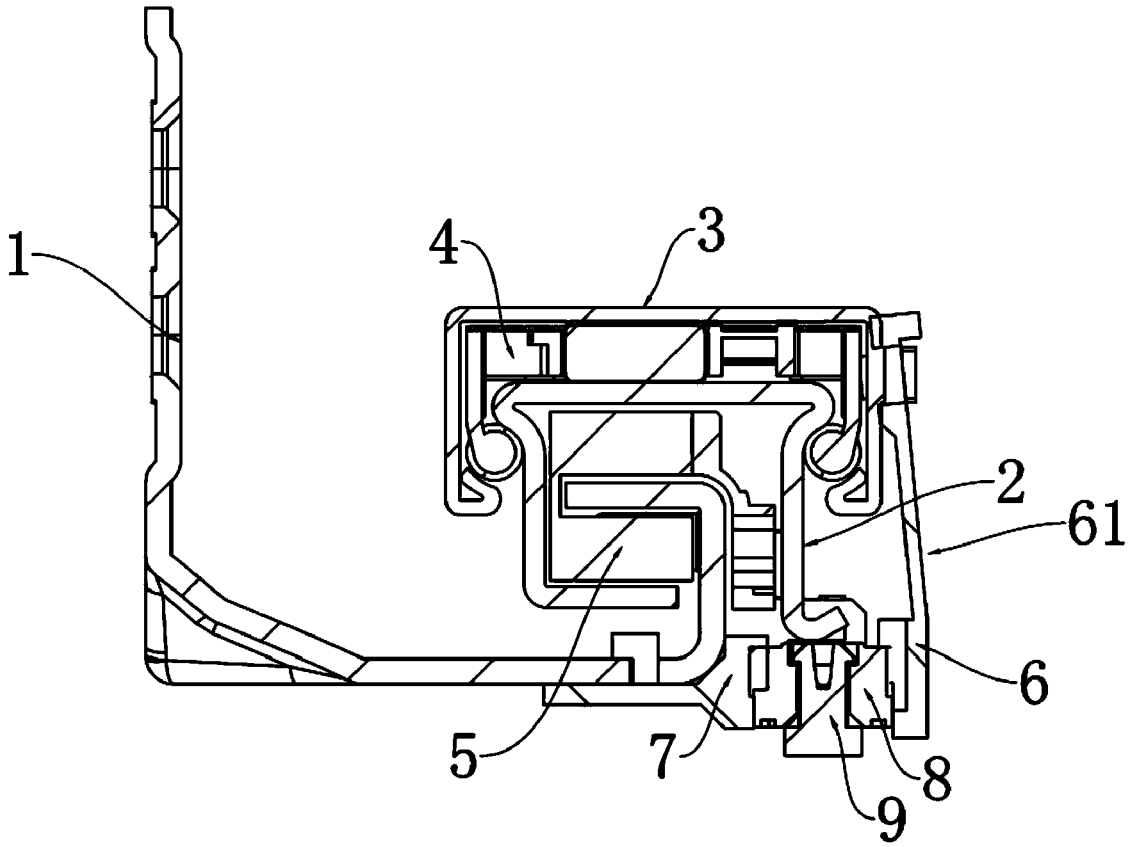
FIG. 2 is a cross-sectional view of the drawer slide of the embodiment.
Figure 3:
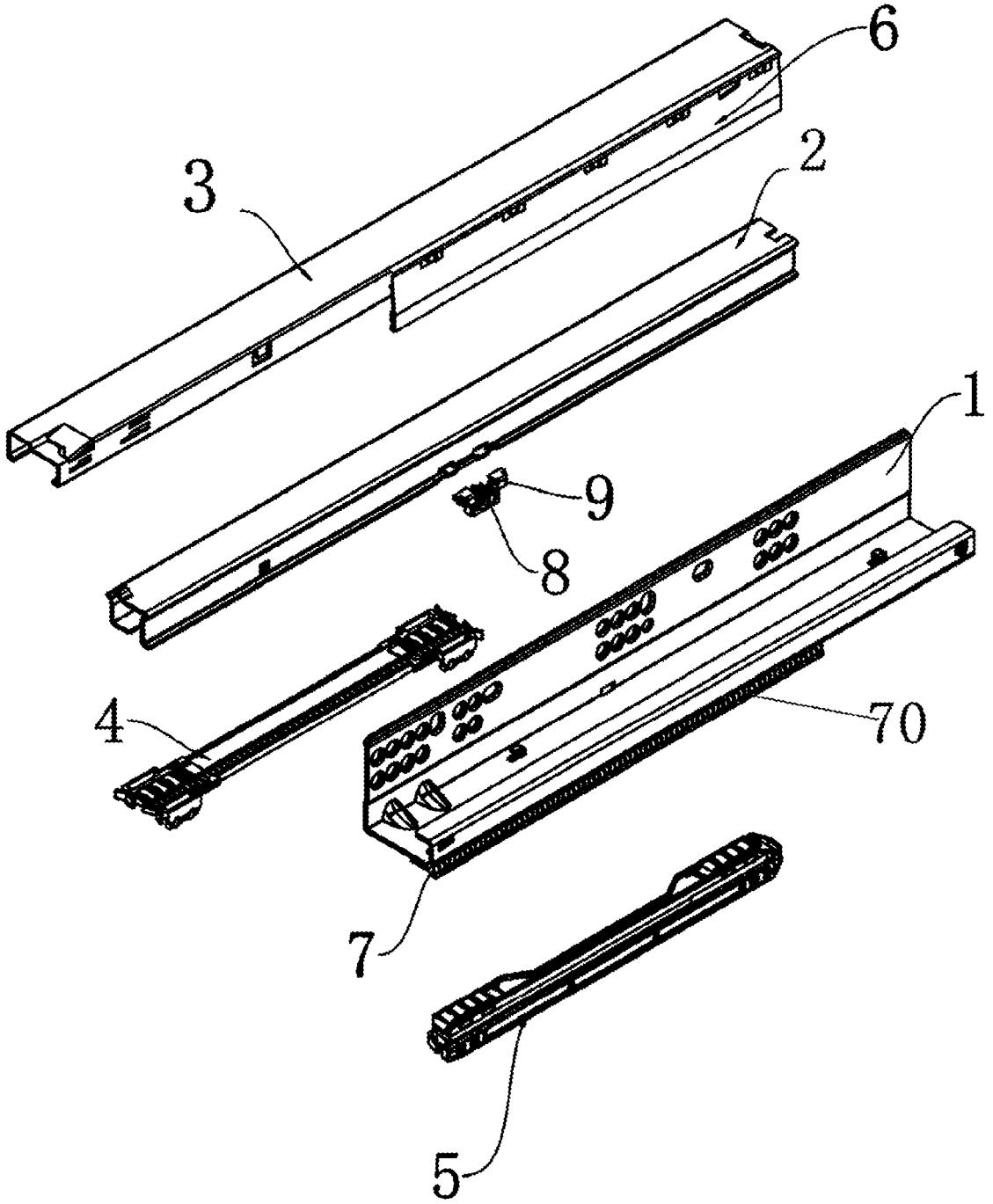
FIG. 3 is an exploded view of the drawer slide of Embodiment I.
Figure 4:
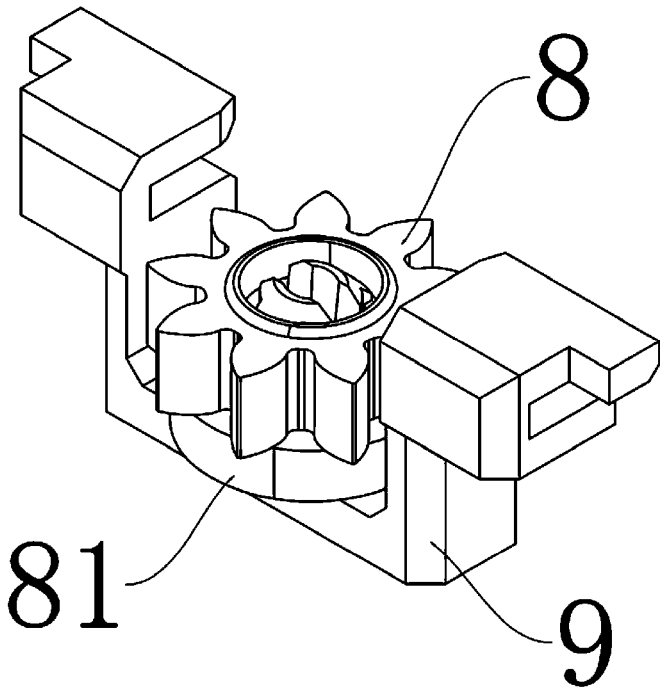
FIG. 4 is a schematic diagram of a synchronizing gear and a gear seat of Embodiment I.
Figure 5:
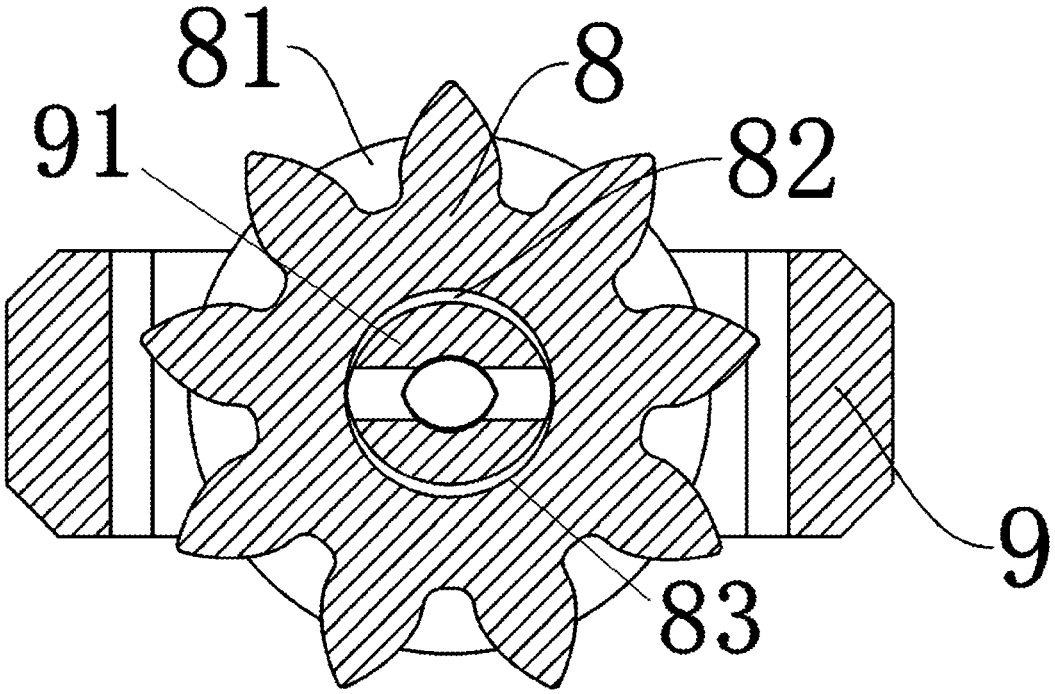
FIG. 5 is a cross-sectional view of the synchronizing gear and the gear seat of Embodiment I.
Figure 6:
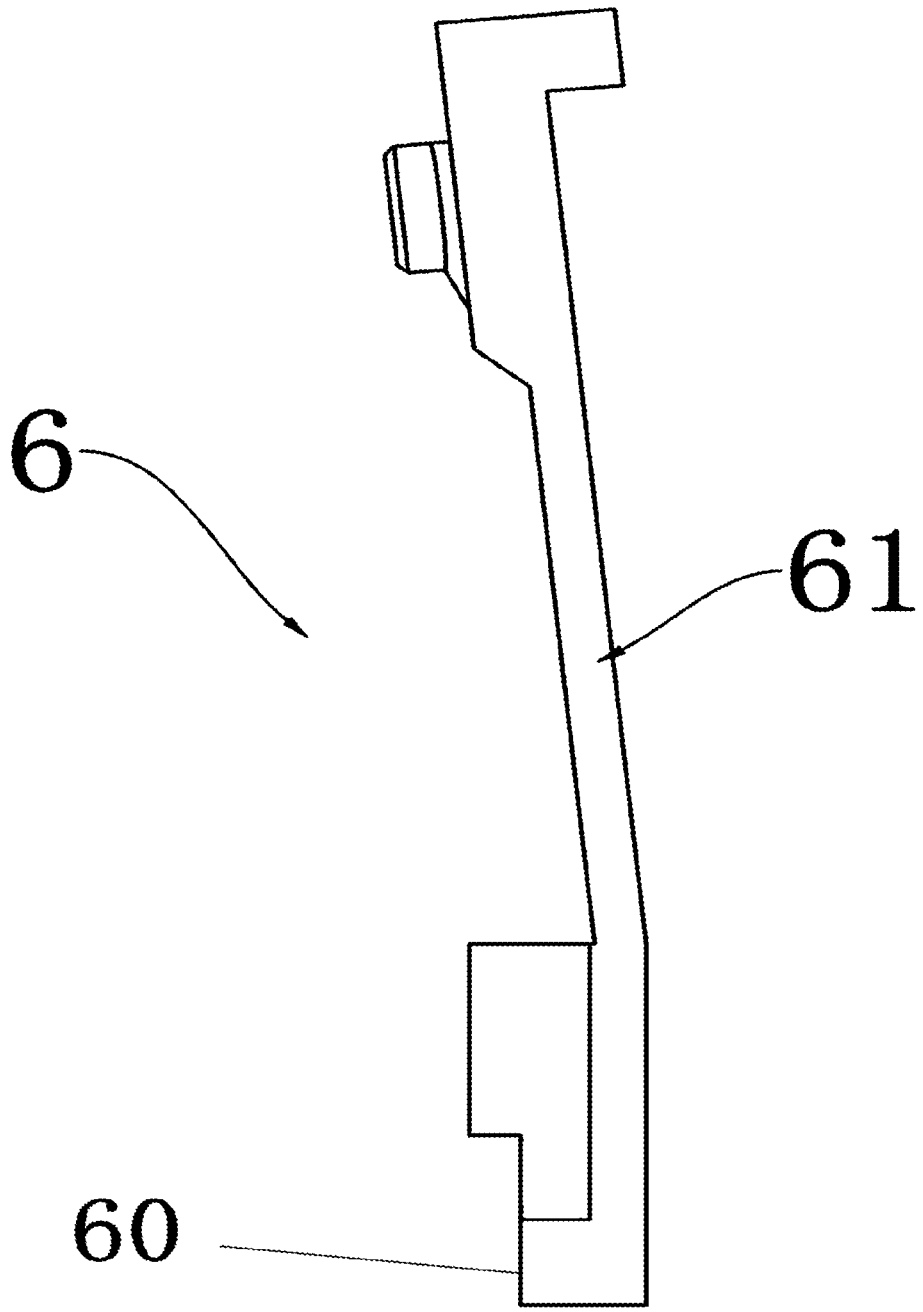
FIG. 6 is a schematic diagram of a first synchronizing rack of the embodiment.
Figure 7:
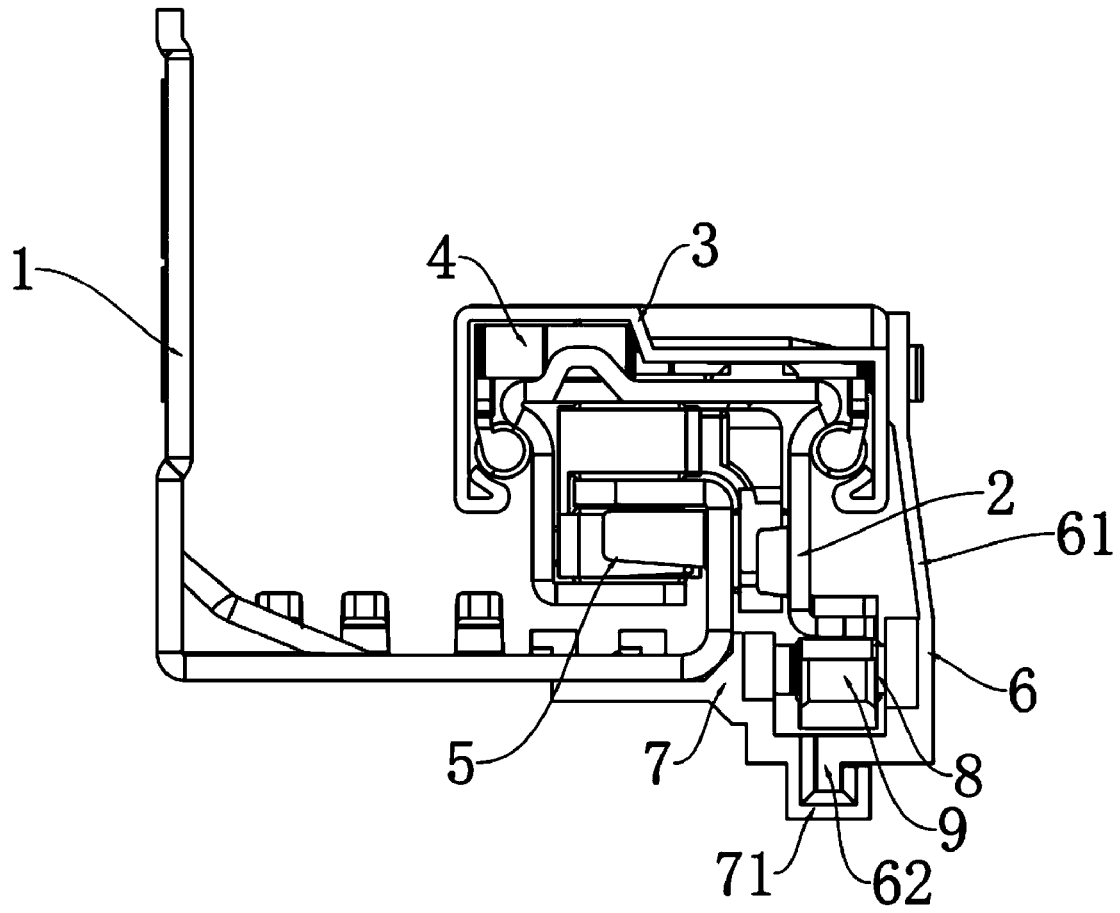
FIG. 7 is a schematic diagram of a movable slide rail of Embodiment II.
Figure 8:
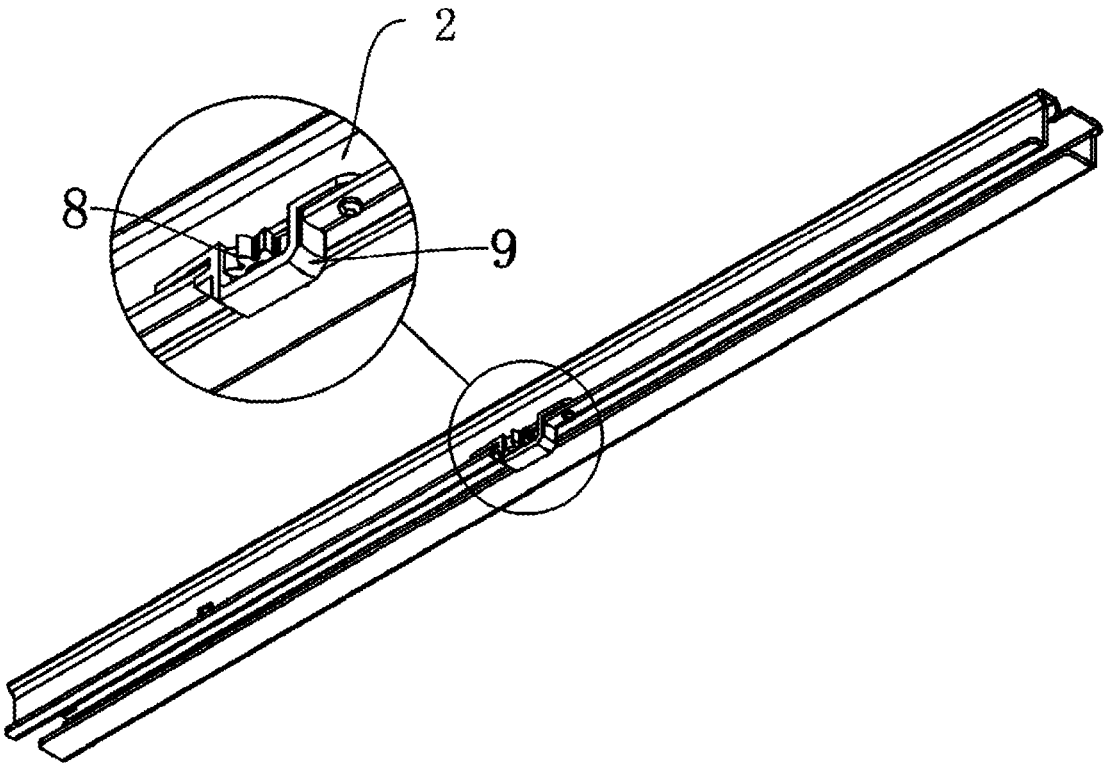
FIG. 8 is a schematic diagram of a middle slide rail and a gear seat of Embodiment II.

With reference to FIG. 7 and FIG. 8, the difference between the present embodiment and Embodiment I is that a first clamping part extending in the drawing direction is formed at a bottom end of the first synchronizing rack 6, and a second clamping part extending in the drawing direction is formed at a bottom end of the second synchronizing rack 7. The second clamping part is of a U-shaped structure and is slidably embedded with the first clamping part, that is, the first clamping part is slidably clamped with the second clamping part. Further, the first synchronizing rack 6 and the second synchronizing rack 7 are capable of sliding relative to each other only in the drawing direction, which limits the displacement of the first synchronizing rack 6 and the second synchronizing rack 7 in the left-right direction, fixes the center distance between the synchronizing gear 8 and the first synchronizing rack 6 and the second synchronizing rack 7, and enhances the stability of the drawing action of the synchronous slide.

In the present embodiment, one end of the gear seat 9 is hinged on the middle slide rail 2 through a pin, and the other end is movably clamped to the middle slide rail 2, such that the gear seat 9 is capable of swinging around a hinged shaft, so as to synchronously drive the synchronizing gear 8 for swing adjustment by a swinging action of the gear seat 9, and the synchronizing gear 8 can be adapted to a relative position between the first synchronizing rack 6 and the second synchronizing rack 7.

Embodiment III:

With reference to FIG. 9, the difference between the present embodiment and Embodiment I is that two limiting gears 81 installed non-coaxially on the gear seat 9 are included. Axes of the two limiting gears 81 are both parallel to an axis of the synchronizing gear 8, the axes of the two limiting gears 81 and the axis of the synchronizing gear 8 are both located in the drawing direction of the slide, and specifications and diameters of the two limiting gears 81 are the same, such that a first pressure-bearing part 60 and a second pressure-bearing part 70 that are in abutment fit with peripheral surfaces of the two limiting gears 81 are respectively formed on the first synchronizing rack 6 and the second synchronizing rack 7.

The above are merely preferred embodiments of the present disclosure rather than limitations on the present disclosure in any form. Any person skilled in the art can make many possible variations and modifications to the technical solutions of the present disclosure or modify them to be equivalent embodiments of the present disclosure using the above disclosed technical contents without departing from the technical solutions of the present disclosure. Therefore, equivalent changes made according to the idea of the present disclosure without departing from the content of the technical solutions of the present disclosure shall be covered within the protection scope of the present disclosure.

The invention claimed is:

1. A drawer synchronous slide, comprising a fixed slide rail (1), a middle slide rail (2), and a movable slide rail (3) connected to each other slidably, wherein a synchronizing gear (8) is arranged on the middle slide rail (2), a first synchronizing rack (6) and a second synchronizing rack (7) arranged horizontally and oppositely are respectively fixed onto the movable slide rail (3) and the fixed slide rail (1), left and right sides of the synchronizing gear (8) are respectively meshed and work in conjunction with a tooth-shaped part of the first synchronizing rack (6) and a tooth-shaped part of the second synchronizing rack (7), an elastic part (61) is arranged on the first synchronizing rack (6), the tooth-shaped part of the first synchronizing rack is elastically pressed towards the synchronizing gear (8) under the action of elastic stress of the elastic part (61), and at least one limiting gear (81) for working in conjunction with each of the first synchronizing rack (6) and the second synchronizing rack (7) in an abutting manner is arranged on the synchronizing gear (8);

wherein the drawer synchronous slide further comprising a gear seat (9) for rotating and installing the synchronizing gear (8), and the gear seat (9) is installed at a bottom end of an outer side wall of the middle slide rail (2); and a vertically extending elliptical shaft (91) is formed on the gear seat (9), a circular hole (83) matched with the elliptical shaft (91) is formed at a central position of the synchronizing gear (8), and an adjustment gap (82) is provided between an outer wall of the elliptical shaft (91) in a short shaft direction and an inner wall of the circular hole (83), such that the synchronizing gear (8) is finely adjusted with the gear seat (9) in the short shaft direction of the elliptical shaft (91).

2. The drawer synchronous slide according to claim 1, wherein the synchronizing gear (8) and the limiting gear (81) are arranged coaxially.

3. The drawer synchronous slide according to claim 2, wherein a first pressure-bearing part (60) and a second pressure-bearing part (70) that are in abutment fit with a peripheral surface of the limiting gear (81) are respectively formed on the first synchronizing rack (6) and the second synchronizing rack (7).

4. The drawer synchronous slide according to claim 2, wherein the limiting gear (81) is integrally formed below the synchronizing gear (8), and the limiting gear (81) has a diameter close to a pitch circle diameter of the synchronizing gear (8).

5. The drawer synchronous slide according to claim 1, wherein one end of the gear seat (9) is hinged on the middle slide rail (2), such that the gear seat (9) is capable of swinging around a hinged shaft.

6. The drawer synchronous slide according to claim 1, wherein a first clamping part (62) is formed on the first synchronizing rack (6), a second clamping part (71) is formed on the second synchronizing rack (7), and the first clamping part (62) is slidably clamped with the second clamping part (71), such that the first synchronizing rack (6) and the second synchronizing rack (7) are capable of sliding relative to each other only in a drawing direction.

7. The drawer synchronous slide according to claim 1, wherein a first cage (5) is arranged between the fixed slide rail (1) and the middle slide rail (2), and a second cage (4) is arranged between the middle slide rail (2) and the movable slide rail (3).

* * * * *